United States Patent [19]

Fuller

[11] Patent Number: 4,795,145

[45] Date of Patent: Jan. 3, 1989

[54] CUT SHEET PAPER MECHANISM

[75] Inventor: Douglas D. Fuller, Contoocook, N.H.

[73] Assignee: Centronics Data Computer Corporation, Hudson, N.H.

[21] Appl. No.: 910,420

[22] Filed: Sep. 22, 1986

[51] Int. Cl.[4] ..... B65H 5/00

[52] U.S. Cl. ..... 271/10; 271/21; 271/118; 271/121; 271/242; 271/170

[58] Field of Search ..... 271/118, 117, 21, 121, 271/242, 257, 170, 3, 4, 10; 400/629, 625, 624

[56] References Cited

U.S. PATENT DOCUMENTS

| | | | |
|---|---|---|---|
| 946,724 | 1/1910 | Dixon | 400/629 X |
| 974,556 | 11/1910 | Dixon | 400/629 X |
| 2,679,801 | 6/1954 | Ford et al. . | |
| 3,210,071 | 10/1965 | Rogers et al. | 271/21 |
| 3,949,979 | 4/1976 | Taylor et al. | 271/10 |
| 4,184,671 | 1/1980 | Sasamori | 271/18 |
| 4,222,557 | 9/1980 | Wu | 271/4 |
| 4,262,894 | 4/1981 | Marano | 271/4 |
| 4,395,032 | 7/1983 | Hipp, Jr. | 271/10 |
| 4,416,559 | 11/1983 | Steinhilber | 400/629 |
| 4,540,297 | 9/1985 | Imaizumi et al. | 271/3 X |
| 4,556,209 | 12/1985 | Tsubo | 271/10 |
| 4,564,187 | 1/1986 | Costa et al. | 271/9 |
| 4,565,462 | 1/1986 | Yamamoto et al. | 271/3 X |
| 4,613,124 | 9/1986 | Lohrmann et al. | 271/170 X |

FOREIGN PATENT DOCUMENTS

| | | | |
|---|---|---|---|
| 185675 | 10/1984 | Japan | 400/629 |
| 1397379 | 6/1975 | United Kingdom | 271/21 |

*Primary Examiner*—Joseph J. Rolla
*Assistant Examiner*—David H. Bollinger
*Attorney, Agent, or Firm*—Nixon & Vanderhye

[57] ABSTRACT

In the paper feed mechanism disclosed herein, a pick roller is journaled in a swing member which is pivoted on a horizontal drive shaft extending across the paper path. The periphery of the pick roller frictionally engages the drive shaft and the swing mechanism depends from the drive shaft through a friction fit. When the drive shaft is rotated in the appropriate direction, the pick roller is swung, due to the frictional fit, against the front sheet of a paper pack and continued rotation of the shaft drives the pick roller into wedging engagement with the sheet, causing the sheet to advance and separate from the pack.

10 Claims, 4 Drawing Sheets

CUT SHEET PAPER MECHANISM

BACKGROUND OF THE INVENTION

The present invention relates to cut sheet paper-feeding mechanism and more particularly to such a mechanism which will pick and feed individual sheets of paper from a vertically oriented pack into a print mechanism located below the pack.

The present invention is an improvement of the paper feed mechanism described in a co-pending, co-assigned application by Frank Pensavecchia et al. entitled Vertical Stand-Alone Printer, filed July 11, 1985, Ser. No. 754,068 now abandoned. The disclosure of said co-pending application is incorporated herein by reference.

In developing a low cost stand-alone printer having a small footprint suitable for use with currently available personal computers, a need has arisen for a very simple and yet reliable paper feed mechanism which will reliably feed single sheets of paper from a vertically oriented pack. The present invention provides such a paper feed mechanism allowing paper to be easily introduced into the printer by means of a vertically oriented bin, without requiring a movable or spring-loaded backplate or a movable or spring-loaded corner retainer such as are required by many prior art cut sheet paper feed devices.

Among the several objects of the present invention may be noted the provision of a cut sheet paper feed mechanism which will reliably feed individual sheets of paper from a vertically oriented paper pack to a printing mechanism located below the pack; the provision of such a mechanism which is of very compact construction; the provision of such a mechanism which does not require a spring-loaded backplate for the pack; the provision of such a mechanism which does not require movable or spring-loaded retainers for buckling the sheets being fed; the provision of such a mechanism which is highly reliable; the provision of such a mechanism which requires very few parts; the provision of such a mechanism which is easily assembled and which is of very low cost. Other objects and features will be in part apparent and in part pointed out hereinafter.

SUMMARY OF THE INVENTION

Briefly, the paper feed mechanism of the present invention is adapted for feeding individual sheets from a paper pack to a printing mechanism located below the pack. The feed mechanism is driven through a horizontal input drive shaft. A swing member depends from the input drive shaft through a friction fit. A pick roller is journaled on the swing member on a horizontal axis parallel to and nominally below the horizontal axis of the input drive shaft. The peripheral surface of the pick roller is itself in frictional engagement with the input drive shaft. Means, such as a bin, is provided for holding a pack of cut sheet paper adjacent the pick roll with the sheets being oriented generally vertically. Rotation of the input drive shaft in one direction will, due to the frictional engagement with the swinging member, cause the pick roller to swing into engagement with the front sheet of paper in the pack. Due to the rim driving of the roller from the drive shaft, the engagement provides progressive wedging engagement of the pick roller between the input drive shaft and the front sheet which causes that sheet to advance and separate from the pack.

BRIEF DESCRIPTION OF THE DRAWINGS

Corresponding reference characters indicate corresponding parts throughout the several views of the drawings

DESCRIPTION OF THE PREFERRED EMBODIMENT

Figure 1:
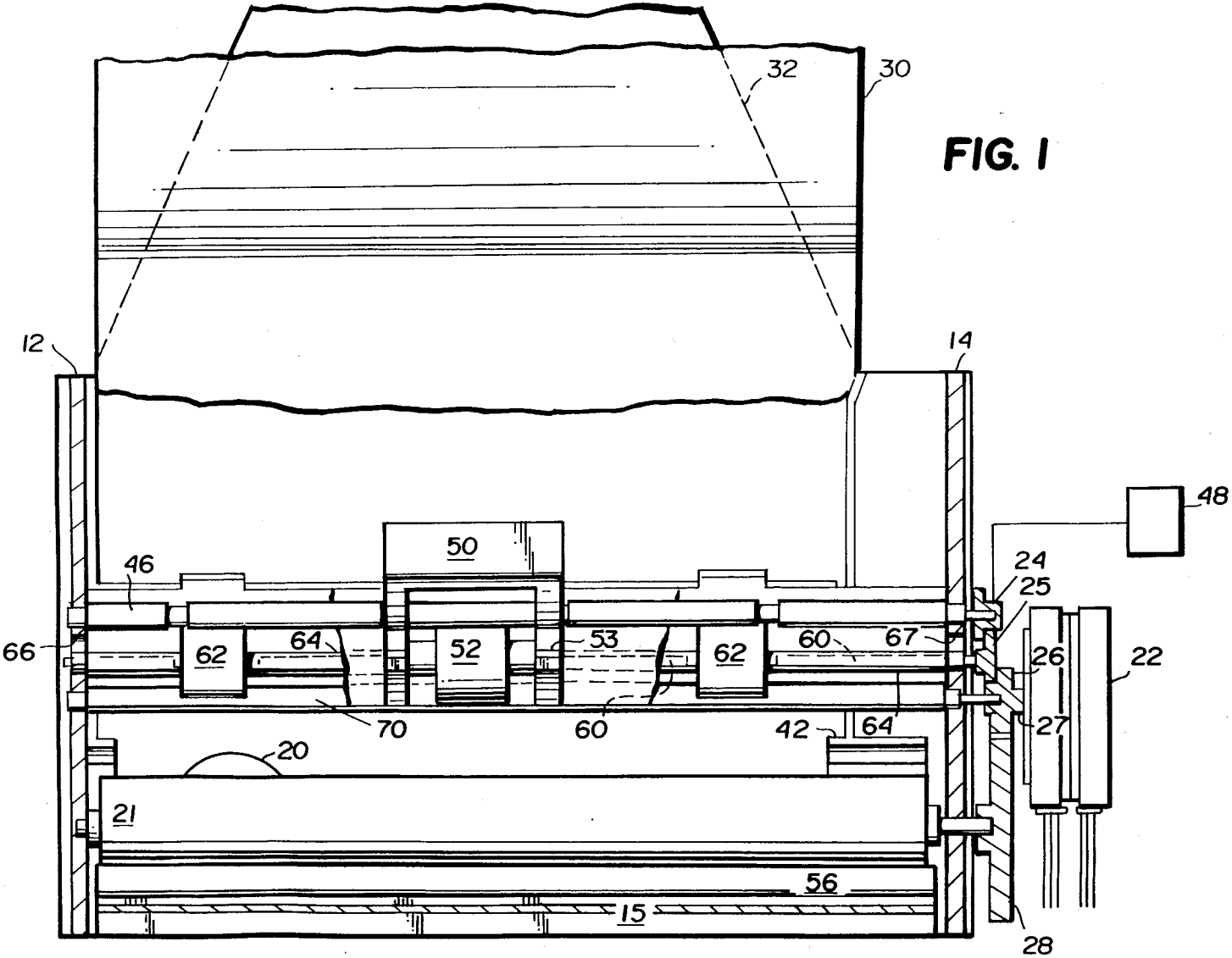
FIG. 1 is a front view of the internal working components of a computer printer employing cut sheet paper feed mechanisms constructed in accordance with the present invention.
Figure 2:
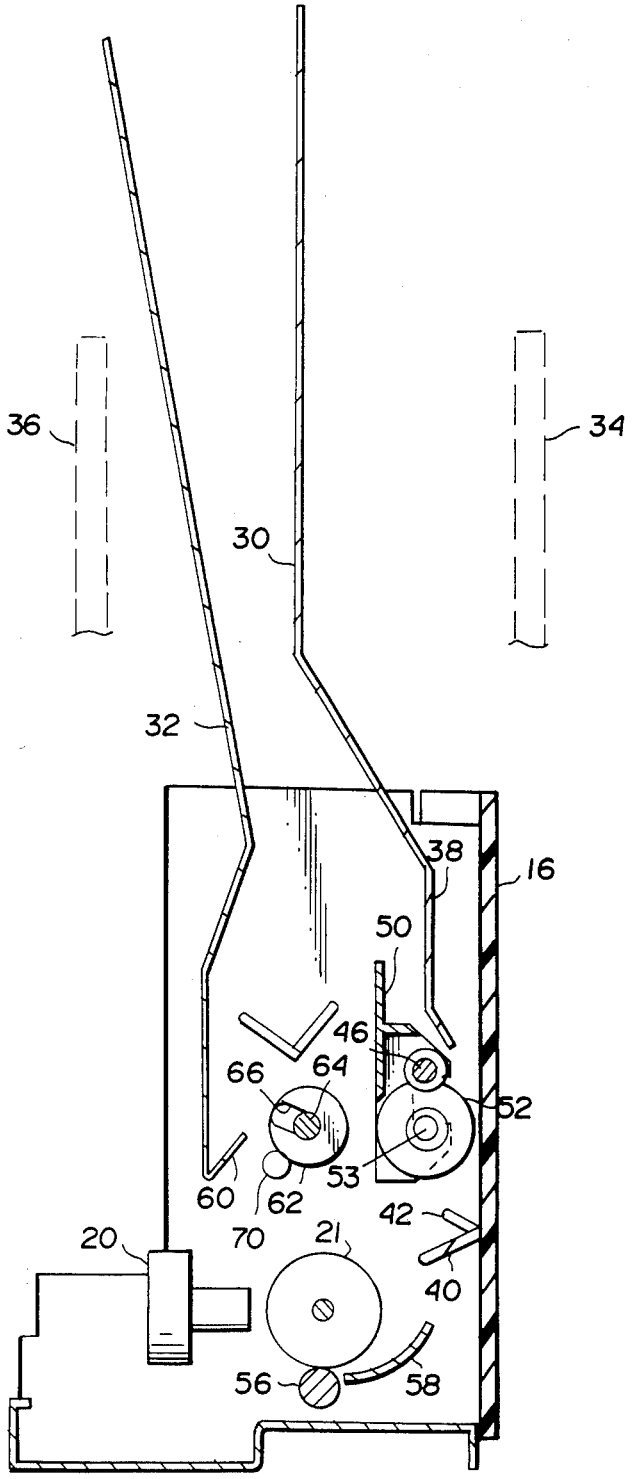
FIG. 2 is a side view, largely in section, of the printer of FIG. 1.

Referring now to FIGS. 1 and 2, it may at the outset be pointed out that the various drive shafts and feed rollers described hereinafter extend between a pair of end plates in which the drive shafts in particular are journaled. These end plates are designated in FIG. 1 by reference characters 12 and 14. The end plates themselves are mounted on a base plate 15 which also carries a laterally transversing printing mechanism, designated generally by reference character 20. Printing mechanism 20 may be of any appropriate type, e.g. of the dot matrix pin printer variety or may be also-called bubble jet printhead. Sheets of paper which are to be printed are carried past the printing mechanism by a paper advancing platen roll 21. A pressure roller 56 is provided for clamping paper to the platen roll and a guide 58 is provided for directing the leading edge of a sheet of paper into the nip between the pressure roll and the platen roll.

A bi-directional stepper motor 22 is provided for powering the drive rolls and shafts, suitable coupling and speed adjustments being provided by gears designated by reference characters 24–28.

A pair of formed panels 30 and 32 are also provided between the end plates. These panels together with the outer enclosure of the printer form input and output bins, both of which are vertically oriented. As indicated previously, FIG. 1 shows only the internal working components of the printer, the housing being omitted. In FIG. 2, the front and back panels of the outer housing are shown in dotted lines and indicated by reference characters 34 and 36 so that the basic configuration of the paper bins can be perceived.

Figure 3:
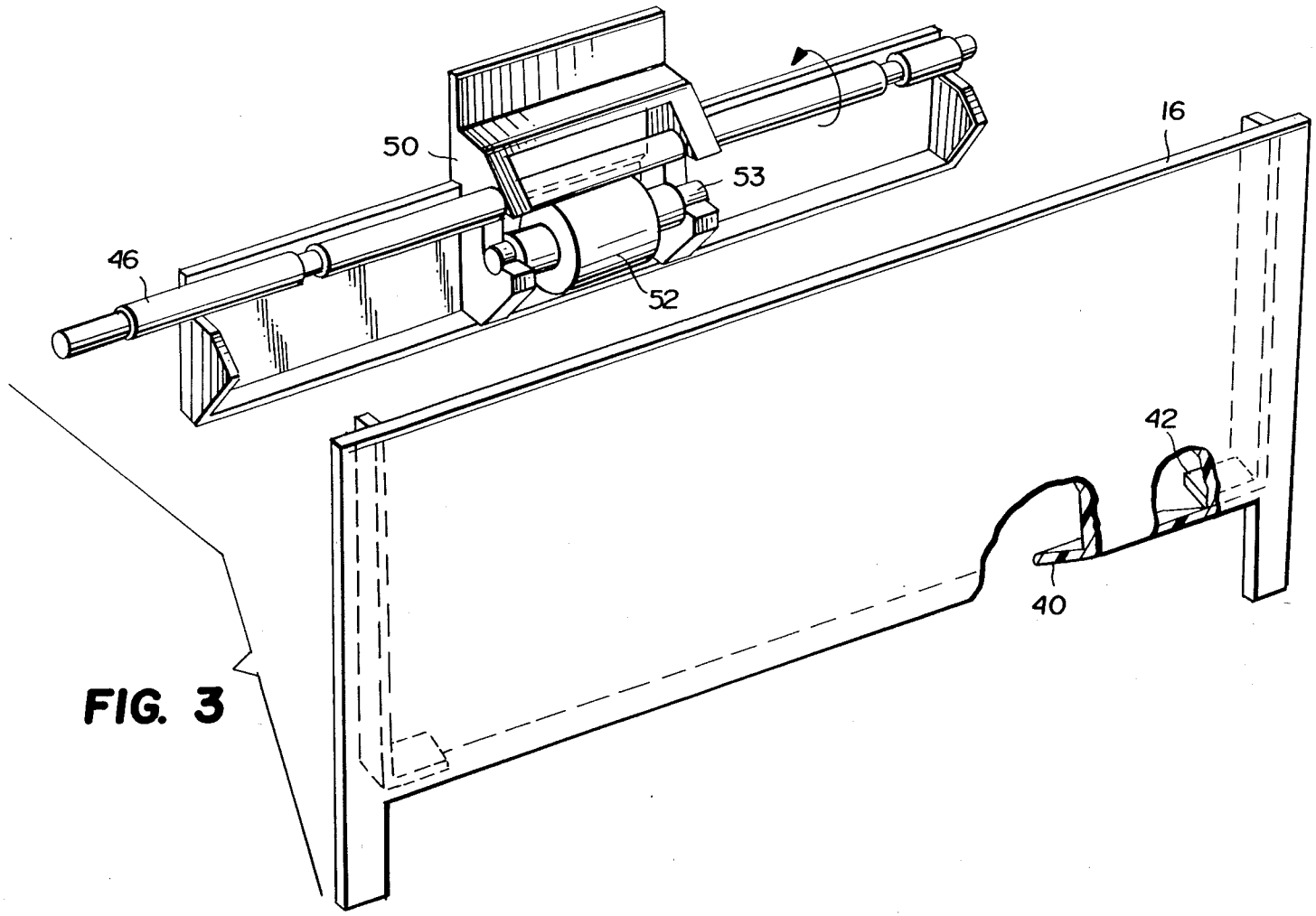
FIG. 3 is a perspective view of a swing member and associated components employed in the printer of FIGS. 1 and 2.
Figure 4:
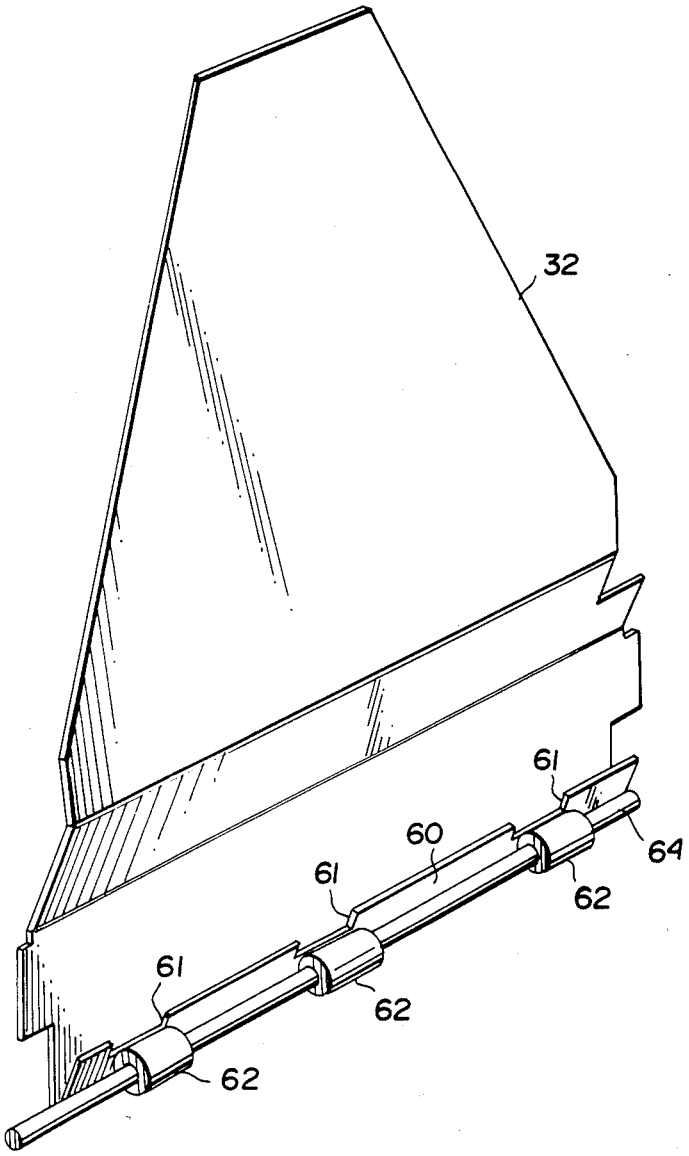
FIG. 4 is a perspective view of an output roller and guide employed in the printer of FIGS. 1 and 2.

A back plate 16 together with the paper support plate 30 form a feed tray designated generally by reference character 38. (See FIGS. 2 and 3) The back plate 16 is preferably an injection molded plastic part providing, in addition to the back panel, a bottom ledge 40 defining the bottom of the feed tray. The bottom ledge 40 is provided at each end with a corner retainer 42 which acts to induce buckling and separation of individual sheets during feeding as described hereinafter. As may be seen in FIGS. 2 and 3, the bottom ledge 40 is inclined downwardly as it extends away from the back plate 16 while the corner retainers are inclined upwardly.

An input drive shaft 46 is journaled in the end plates 12 and 14 and extends across the width of the paper generally adjacent the input pack. Input drive shaft 46 is driven through the gearing so as to rotate in the same direction as the drive roll or platen 21. However, a manually engageable clutch 48 is preferably interposed in the drive train for this shaft so the feed mechanism can be disengaged at will, e.g. to allow the ejection of a finished sheet without picking and starting a new sheet from the pack or to allow manual insertion of a single sheet or envelope.

An injection molded swing member, designated generally by reference character 50, is pivotally mounted on the input shaft 46 and this swing member carries a pick roller 52 which is rotatable on an axle 53. The axle 53 is parallel to the input drive shaft 46, the swing member being formed so that both effectively snap into the swing member 50 in respective notches and are retained, or partially journalled therein.

The pick roll 52 employs a compliant, e.g. soft rubber, surface and the spacing between the axis of the pick roll and the axis of the drive shaft 46 is such that the peripheral surface of the pick roll is in frictional engagement with the drive shaft 46. The swing member and pick roll assembly can be seen in greater detail in FIG. 3.

Picking and feeding of a sheet of paper is initiated when the input drive shaft 46 is driven in a counter-clockwise direction as viewed in FIG. 2. Due to the frictional engagement between the swing member and the drive shaft 46, counter-clockwise rotation of the shaft 46 causes the swing member 50 to carry the pick roll 52 to the right so that it engages the front (leftmost) sheet of a pack of paper in the feed tray. Once initial engagement has occurred, the driving of the pick roll 52 by the drive shaft 46 will cause a progressive wedging engagement of the pick roller between the input drive shaft 46 and the front sheet of paper. As this force builds up, it will eventually cause the center portion of the front sheet to advance, buckling the corners of the sheet against the corner retainers 42 and causing it to separate from the rest of the pack.

As a given sheet separates from the pack and advances, it is led, by guide 58, into the nip between the paper advancing platen roll 21 and pressure roll 56. While the sheet is being fed by the pick roll, however, it will be understood that the drive roll is also rotating counter-clockwise so that the advancing sheet will not actually advance into the nip but rather will buckle. Further, the back pressure will cause the advancing sheet to self-align with the platen roll 21 since the pick roll 52 is relatively centrally located with respect to the width of the paper. As is understood by those skilled in the art, this self-aligning is useful in order to assure level printing across the page.

After a time interval sufficient to allow this self-aligning process to take place, the printer controller causes the motor 22 to reverse direction. This action causes the sheet being fed to be picked up in the nip between the pressure roll 56 and platen roll 21. At the same time, due to the reverse direction of the input drive shaft 46, the swing member and pick roll are moved away from the pack so that control of the paper movement is completely transferred from the feed mechanism to the platen roll.

During printing, the position of the sheet being imprinted is under the control of the platen roll and the sheet is fed progressively in stepwise fashion to facilitate printing by the printing mechanism 20. As the leading edge of the sheet advances from the platen roll during printing, it is led, by guides (not shown), into a gap between a guide surface 60 which is formed by a lower lip on the panel member 32 and a set of output rollers 62 which are carried on a roller shaft 64.

The ends of the roller shaft 64 ride in arcuate slots 66 and 67 formed in the end plates 12 and 14. The arc of these slots is centered on the axis of an output drive shaft 70. Output shaft 70 is driven through the gearing so as to also rotate in the same direction as the platen roll 21. The output rollers 62 are provided with a compliant, e.g. soft rubber, periphery and their diameter is such that their peripheries are in frictional engagement with the output drive shaft 70.

While a sheet being printed is being advanced by the platen roll 21, the roller shaft is normally in the position shown in FIG. 2 so that the rollers 62 are spaced away from the guide surface 60. However, when printing of the sheet is completed, the motor 22 is again reversed. Thus, the output drive shaft 70 will be rotated in a counter-clockwise direction. The frictional engagement of the output rollers 62 with this shaft will cause them to rotate in a clockwise direction and the shaft 64 on which the output rollers are mounted will also be so rotated. This rotation of the roller shaft 64 will cause its axis to in effect "walk" around the outer surface of the arcuate slots 66 and 67 so that the output drive shaft 70, together with the rollers 62 will move, to the left as illustrated in FIG. 2. Accordingly, the rollers 62 will engage a sheet of paper which, at this point, will be overlying the guide surface 60.

The guide surface 60 includes a series of notches 61, one for each of the rollers 62, so that a sheet of paper overlying the guide surface 60 will effectively bridge the respective notch. When the rollers 62 walk over into engagement with a sheet of paper overlying the guide surface 60, it has been found that this arrangement facilitates driving of the paper by the rollers 62. Accordingly, the sheet will be fed up and away from the printing mechanism until its lower edge clears the end of the guide surface 60 and the sheet essentially drops in the output tray. At the same time, the finished sheet is being completed, the input feed mechanism will be picking and serving to the printing mechanism a new sheet unless, of course, the clutch 48 has been disengaged as described previously.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a printer, a cut sheet paper feed mechanism for feeding individual sheets from a paper pack to a printing mechanism located below the pack, said feed mechanism comprising:

a horizontal input drive shaft;

a swing member journaled on said input drive shaft through a friction fit such that mounting of said swing member on said input drive shaft facilitated;

a pick roller including a peripheral surface, said pick roller journaled on said swing member on a horizontal axis which is parallel to and nominally below the axis of said input drive shaft, the peripheral surface of the pick roller being in frictional engagement with said input drive shaft;

means for holding a pack of cut sheet paper adjacent the said pick roller with individual sheets of said pack of cut sheet paper being oriented essentially vertically, whereby rotation of said input drive shaft in one direction in response to frictional engagement of said input drive shaft with said swing member causes said pick roller to swing into engagement with a front sheet of said pack, such that continued rotation of said input drive shaft causes progressively wedging engagement of the pick roller between said input drive shaft and said front sheet which, in turn, causes said front sheet to advance and separate from the pack.

2. A paper feed mechanism according to claim 1 wherein said swing member comprises at least two pair of notches spaced apart with the notches of each pair facing one another, said pick roller axle mounted for frictional, rotational movement within one pair of notches, said input drive shaft mounted for frictional rotational movement within the other pair of notches, the spacing between the notches in each pair dimensioned to maintained the peripheral surface of said pick roller in frictional engagement with said input drive shaft.

3. A paper feed mechanism according to claim 2 wherein said notches are configured to permit snap action insertion and retention of said input drive shaft and pick roller axle.

4. In a printer, a cut sheet paper feed mechanism for feeding individual sheets from a paper pack to a printing mechanism located below the pack, said feed mechanism comprising:

a horizontal input drive shaft;

a swing member depending from said input drive shaft through a friction fit;

a pick roller including a peripheral surface, said pick roller journaled on said swing member on a horizontal axis which is parallel to and nominally below the axis of said input drive shaft, the peripheral surface of the pick roller being in frictional engagement with a peripheral surface of said input drive shaft;

below said pick roller, a horizontal paper advance roll;

a pressure roll for clamping a sheet of paper against said advance roll, said pressure roll and said advance roll forming a nip;

means for holding a pack of cut sheet paper adjacent the said pick roller with individual sheets of said pack of cut sheet paper being oriented generally vertically, means for rotating said input drive shaft in one direction to cause, due solely to said frictional engagement with said swing member, said pick roller to swing into engagement with the front sheet of paper, said engagement providing progressively wedging engagement of the pick roller between said input drive shaft and said front sheet which causes said front sheet to buckle in one direction, separate from the pack, and then advance in said one direction to said paper advance roll, means for rotating said pressure and advance rolls, the direction of said last named rotation causing said advancing sheet not to advance into said nip, but to buckle, the resulting back pressure on said advancing sheet causing said advancing sheet to align itself with said paper advance roll.

5. A paper feed mechanism as set forth in claim 4 wherein said input drive shaft is driven from said paper advance platen roll through a manually operable clutch, the rotation of the input drive shaft being in the same direction as said paper advance roll.

6. In a printer, a cut sheet paper feed mechanism for feeding individual sheets from a paper pack along a path to a printing mechanism located below the pack, wherein said individual sheets have length and width dimensions, said feed mechanism comprising:

a horizontal input drive shaft;

a swing member depending form said input drive shaft through a friction fit;

a pick roller including a peripheral surface, said pick roller journaled on said swing member on a horizontal axis which is parallel to and nominally below the axis of said input drive shaft, said pick roller being located essentially midway across the width of the paper in said path, the peripheral surface of the pick roller being in frictional engagement with a peripheral surface of said input drive shaft;

below said pick roll, a horizontal paper advance platen roll, said input drive shaft rotatable in the same direction as said advance roll;

a pressure roll for clamping a sheet of paper aganist said paper advance platen roll, said pressure roll and said paper advance platen roll forming a nip;

means for holding a pack of cut sheet paper adjacent said pick roller with individual sheets of said pack being oriented generally vertically, said holding means including, at each lower corner of the pack, retainers displaced below said pack for restraining the pack and buckling the corner of a sheet upon being separated from the pack, whereby rotation of said input drive shaft in one direction will, due solely to said frictional engagement with said swing member, cause said pick roller to swing into engagement with a front sheet of paper in said pack, said engagement providing progressively wedging engagement of the pick roller between said input drive shaft and said front sheet which causes said front sheet to advance and separate form the pack by buckling the corners of the sheet against said corner retainers.

7. A paper feed mechanism as set forth in claim 6 and further including a guide projecting downwardly below said pick roller for leading said front sheet into said nip.

8. A paper feed mechanism according to claim 6 wherein said swing member comprises at least two pair of notches spaced apart, said pick roller axle mounted for frictional, rotational movement within one pair of notches, and said input drive shaft mounted for frictional rotational movement within the other pair of notches.

9. In a printer, a cut sheet paper feed mechanism for feeding individual sheets from a paper pack to a printing mechanism located below the pack, said feed mechanism comprising:

a horizontal input drive shaft;

a swing member depending from said input drive shaft through a friction fit;

a pick roller including a peripheral surface, said pick roller journaled on said swing member on a horizontal axis which is parallel to and nominally below the axis of said input drive shaft, the peripheral surface of the pick roller being in fricitonal engagement with a peripheral surface of said input drive shaft;

means for holding a pack of cut sheet paper adjacent said pick roller with individual sheets of said pack being oriented generally vertically, said holding means including, along a bottom edge of the pack, a downwardly inclined shelf and, at each lower corner of the pack, an upwardly inclined retainer for restraining the pack and buclking the corner of a sheet being fed from the pack, whereby rotation of said input drive shaft in one direction will, due solely to said frictional engagement with said swing member, causes said pick roller to swing into engagement with a front sheet of paper in said pack, said engagement providing progressively wedging engagement of the pick roller between said input drive shaft and said front sheet which causes said front sheet to advance and separate from the pack by buckling the corners of the sheet against said corner retainers.

10. In a printer, a cut sheet paper feed mechanism for feeding individual sheets from a paper pack to a printing mechanism, said feed mechanism comprising:

a drive shaft;

a swing member journaled on said drive shaft to such that mounting of said swing member on said drive shaft is facilitated;

a pick roller including a peripheral surface, said pick roller journaled on said swing member for engagement with a peripheral surface of said drive shaft, the peripheral surface of the pick roller being in frictional engagement with said drive shaft;

means for holding a pack of cut sheet paper adjacent said pick roller; and means for rotating said drive shaft, such that said swing member, in response to rotation of said drive shaft, causes said pick roller to swing into engagement wiht a front sheet of paper in said pack, said engagement providing progressively wedging engagement of the pick roller between said drive shaft and said front sheet which causes said front sheet to advance and separate from the pack.

* * * * *